US007204713B2

(12) United States Patent
Rushton

(10) Patent No.: US 7,204,713 B2
(45) Date of Patent: Apr. 17, 2007

(54) APPARATUS FOR CONVERTING A DIVE LIGHT INTO A CANISTER LIGHT

(75) Inventor: Adam W. Rushton, Kingston (CA)

(73) Assignee: What Works, Works! Inc., Kingston, Ontario (CA)

( * ) Notice: Subject to any disclaimer, the term of this patent is extended or adjusted under 35 U.S.C. 154(b) by 0 days.

(21) Appl. No.: 11/303,956

(22) Filed: Dec. 19, 2005

(65) Prior Publication Data

US 2006/0158907 A1 Jul. 20, 2006

Related U.S. Application Data

(60) Provisional application No. 60/636,520, filed on Dec. 17, 2004.

(51) Int. Cl.
*H01R 3/00* (2006.01)

(52) U.S. Cl. ..... 439/500; 439/638; 439/320; 362/105; 362/106; 362/108

(58) Field of Classification Search ..... 439/500, 439/638, 271, 320; 362/105, 106, 108
See application file for complete search history.

(56) References Cited

U.S. PATENT DOCUMENTS 1,286,800 A * 12/1918 Schulte ..... 362/105
3,828,201 A * 8/1974 Allen, Sr. ..... 307/150
4,817,212 A 4/1989 Benoit
4,877,167 A 10/1989 McNemar
5,105,346 A 4/1992 Acks et al.
5,571,279 A * 11/1996 Chiang ..... 362/198
D385,637 S * 10/1997 Rombough ..... D26/43
5,707,137 A * 1/1998 Hon ..... 362/183
5,767,932 A * 6/1998 Gordon ..... 351/43
6,165,013 A * 12/2000 Broussard ..... 439/606
6,280,050 B1 8/2001 Bird et al.
6,416,199 B1 * 7/2002 Heine ..... 362/105
6,501,197 B1 * 12/2002 Cornog et al. ..... 307/150
6,718,136 B2 4/2004 Bird et al.
2004/0141317 A1 * 7/2004 Sun ..... 362/198

FOREIGN PATENT DOCUMENTS

CA 2156243 A1 2/1996

* cited by examiner

*Primary Examiner*—Tho D. Ta
(74) *Attorney, Agent, or Firm*—Freedman & Associates

(57) ABSTRACT

The present invention relates to a converter for converting a dive light into a canister light. The converter comprises a first adaptor for mating in a waterproof fashion with a head of a dive light, a second adaptor for mating in a waterproof fashion with a battery compartment of the dive light, and a connector cable having a first end affixed to the first adaptor in a waterproof fashion and a second end affixed to the second adaptor in a waterproof fashion. In one embodiment, the first adaptor comprises a hand mount assembly for mounting holding the head of the dive light on the back of a diver's hand while the battery compartment of the dive light is attached to a belt worn around a diver's waist. The converter is manufactured at relatively low cost enabling recreational divers and beginners to acquire a converted dive light at relatively low cost compared with commercially available canister lights.

16 Claims, 10 Drawing Sheets

APPARATUS FOR CONVERTING A DIVE LIGHT INTO A CANISTER LIGHT

This application claims benefit from U.S. Provisional Patent Application No. 60/636,520 filed Dec. 17, 2004, the entire contents of which is incorporated herein by reference.

FIELD OF THE INVENTION

This invention relates generally to illumination devices for divers and in particular to a converter for converting a dive light into a canister light.

BACKGROUND OF THE INVENTION

Underwater exploration is virtually impossible without the use of lighting equipment. For example, approximately 60% of sunlight is absorbed in the first meter of water depth and approximately 80% is of sunlight is absorbed in the first ten meters of water depth. Moreover, even at relatively shallow depths, artificial lighting is necessary to see objects in shadows or in crevices. Exploration of caves and shipwrecks is impossible without the use of some kind of lighting equipment.

Handheld submersible flashlights or "dive lights" are well known in the art and are most commonly used by beginners and recreational divers. Dive lights are readily available at relatively low cost for providing sufficient lighting in situations encountered by recreational divers and are operable to water depths of approximately 150 m. However, holding in one hand a dive light substantially impedes the underwater movement and increases task loading of a diver. Obviously, there are numerous situations, for example, the exploration of a shipwreck, where a diver needs to have both hands free for his or her own safety. A further safety concern is the loss of a dive light. For example, when exploring a shipwreck a diver is suddenly experiencing a strong current requiring holding on with both hands. In such a situation it is very likely to let loose of the dive light resulting in a possible loss of the same. Moreover, dive lights are generally bulky and difficult to grasp. Consequently, when holding such dive lights a diver needs to switch hands in order to alleviate strain, resulting in an increased risk of loosing the dive light while switching hands. Furthermore, divers often have to switch hands to operate other dive gear and, therefore, tether their lights to their wrists to avoid loosing a dropped light resulting in a very significant entanglement hazard.

Due to the above mentioned safety risks, as well as to free both hands, professional divers use "canister lights." Typical canister lights comprise a canister containing a battery pack which is coupled by a cable to a hand or head mounted lamp assembly. The canister is typically strapped to the diver's torso or a tank of the diver's breathing apparatus. Since the canister is not handheld typical canister lights comprise large battery packs for providing superior illumination compared to dive lights. For beginners and recreational divers, the canister lights have several drawbacks. Firstly, the canister lights are built for use by technical divers and are in general prohibitively expensive for beginners and recreational divers. Secondly, the canisters are typically very bulky and heavy, making the use of such lights difficult with respect to balance and trim for less experienced divers.

It would be advantageous to overcome the drawbacks of the prior art by providing an illumination system particularly for recreational divers and beginners that frees both hands of the diver, is less bulky and less heavy than a typical canister light, and is manufactured at relatively low cost.

SUMMARY OF THE INVENTION

It is, therefore, an object of the invention to provide an illumination system that frees both hands of the diver can be less bulky and less heavy than a typical canister light and is manufactured at relatively low cost by converting a dive light into a canister light.

It is further an object of the invention to provide a converter for converting a dive light into a canister light.

In accordance with the present invention there is provided a converter comprising:

a first adaptor for mating in a waterproof fashion with a head of a dive light, the first adaptor comprising first electrical contacts for engaging electrical contacts of the head of the dive light;

a second adaptor for mating in a waterproof fashion with a battery compartment of the dive light, the second adaptor comprising second electrical contacts for engaging electrical contacts of the battery compartment of the dive light; and, a connector cable having a first end affixed to the first adaptor in a waterproof fashion and a second end affixed to the second adaptor in a waterproof fashion, the connector cable for providing electrical communication between the first and the second electrical contacts.

In accordance with the present invention there is further provided a converter comprising:

a first housing for mating in a waterproof fashion with a head of a dive light at a first end, the first housing comprising an opening at a second opposite end;

first electrical contacts disposed within the first housing, the first electrical contacts for engaging electrical contacts of the head of the dive light;

a second housing for mating in a waterproof fashion with a battery compartment of the dive light at a first end, the second housing comprising an opening at a second opposite end;

second electrical contacts disposed within the second housing, the second electrical contacts for engaging electrical contacts of the battery compartment of the dive light;

a connector cable having a first end affixed to the first housing in a waterproof fashion and a second end affixed to the second housing in a waterproof fashion, the connector cable for providing electrical communication between the first and the second electrical contacts;

first and second compression fittings for affixing the first and the second end of the connecting cable to the opening of the first and the second housing, respectively, in a waterproof fashion;

a first mount assembly affixed to the first housing, the first mount assembly for attaching the first housing to one of a back of a hand, a head, and a mask of a breathing apparatus; and, a second mount assembly for attaching the one of the battery compartment and the second housing to one of a belt, an upper arm, a lower arm, and a tank of a breathing apparatus.

In accordance with the present invention there is yet further provided a method for converting a dive light comprising:

providing a first adaptor, the first adaptor comprising first electrical contacts for engaging electrical contacts of a head of the dive light when the first adaptor is mated with the head of the dive light, a second adaptor, the second adaptor comprising second electrical contacts for engaging electrical contacts of a battery compartment of the dive light when the second adaptor is mated with the battery compartment of the dive light, and a connector cable having a first end affixed to the first adaptor in a waterproof fashion and a second end affixed to the second adaptor in a waterproof fashion, the connector cable for providing electrical communication between the first and the second electrical contacts;

mating in a waterproof fashion the first adaptor with the head of the dive light; and, mating in a waterproof fashion the second adaptor with the battery compartment of the dive light.

BRIEF DESCRIPTION OF THE FIGURES

Exemplary embodiments of the invention will now be described in conjunction with the following drawings, in which.

DETAILED DESCRIPTION OF THE INVENTION

Figure 1:
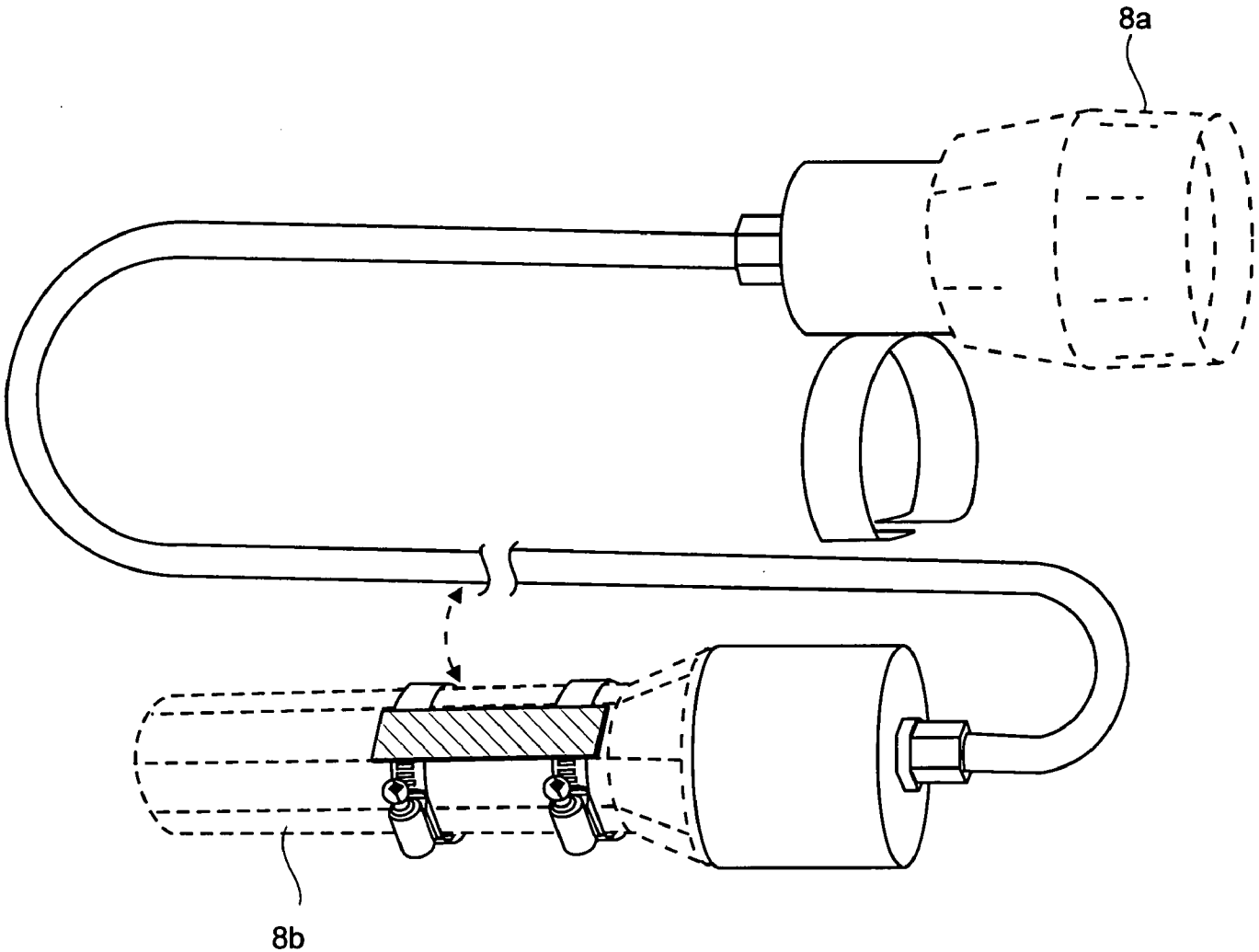
FIGS. 1 and 2*a* are simplified block diagrams schematically illustrating a perspective view of a preferred embodiment of a converter according to the present invention.
Figure 2A:
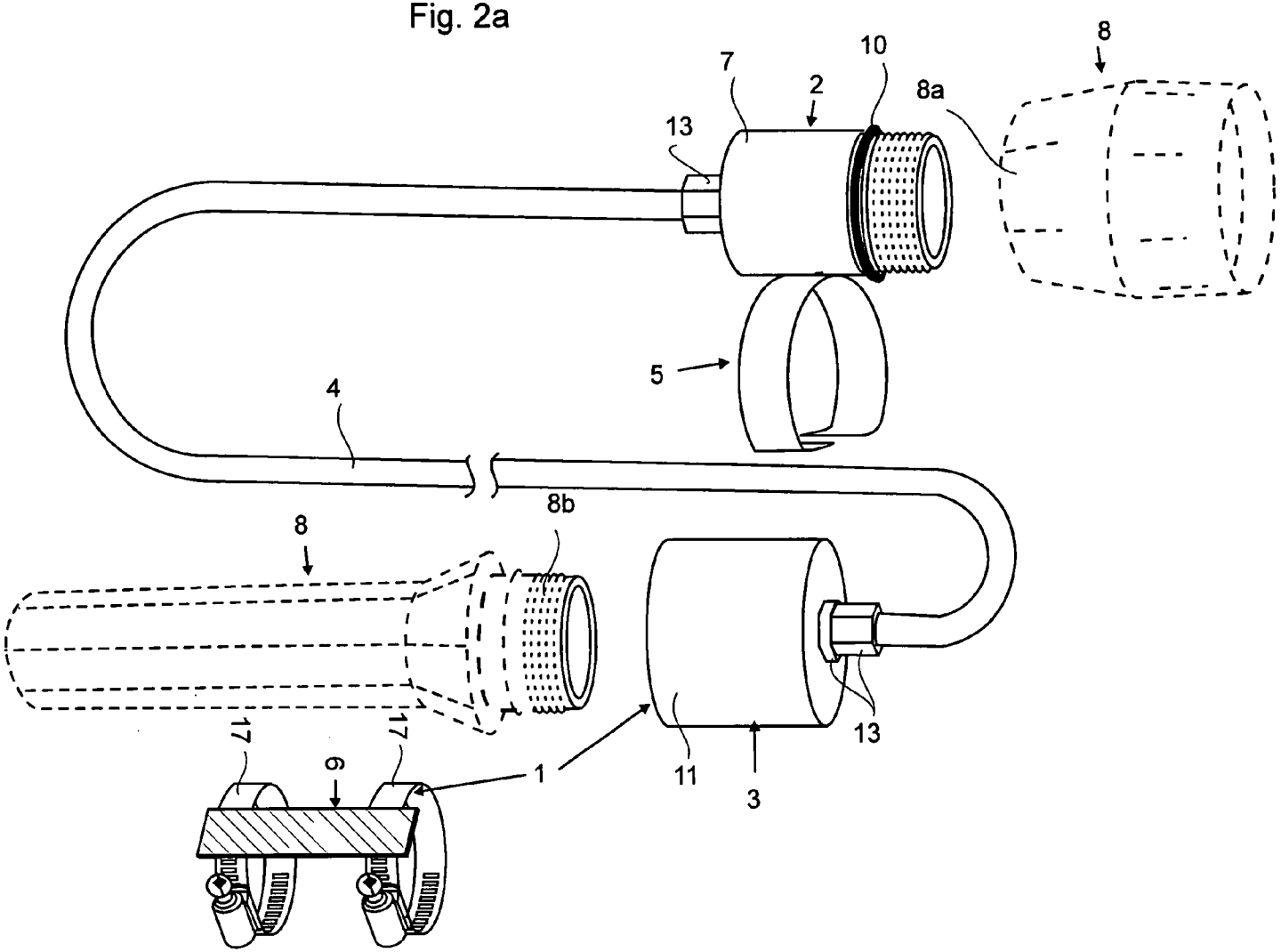
Figure 2B:
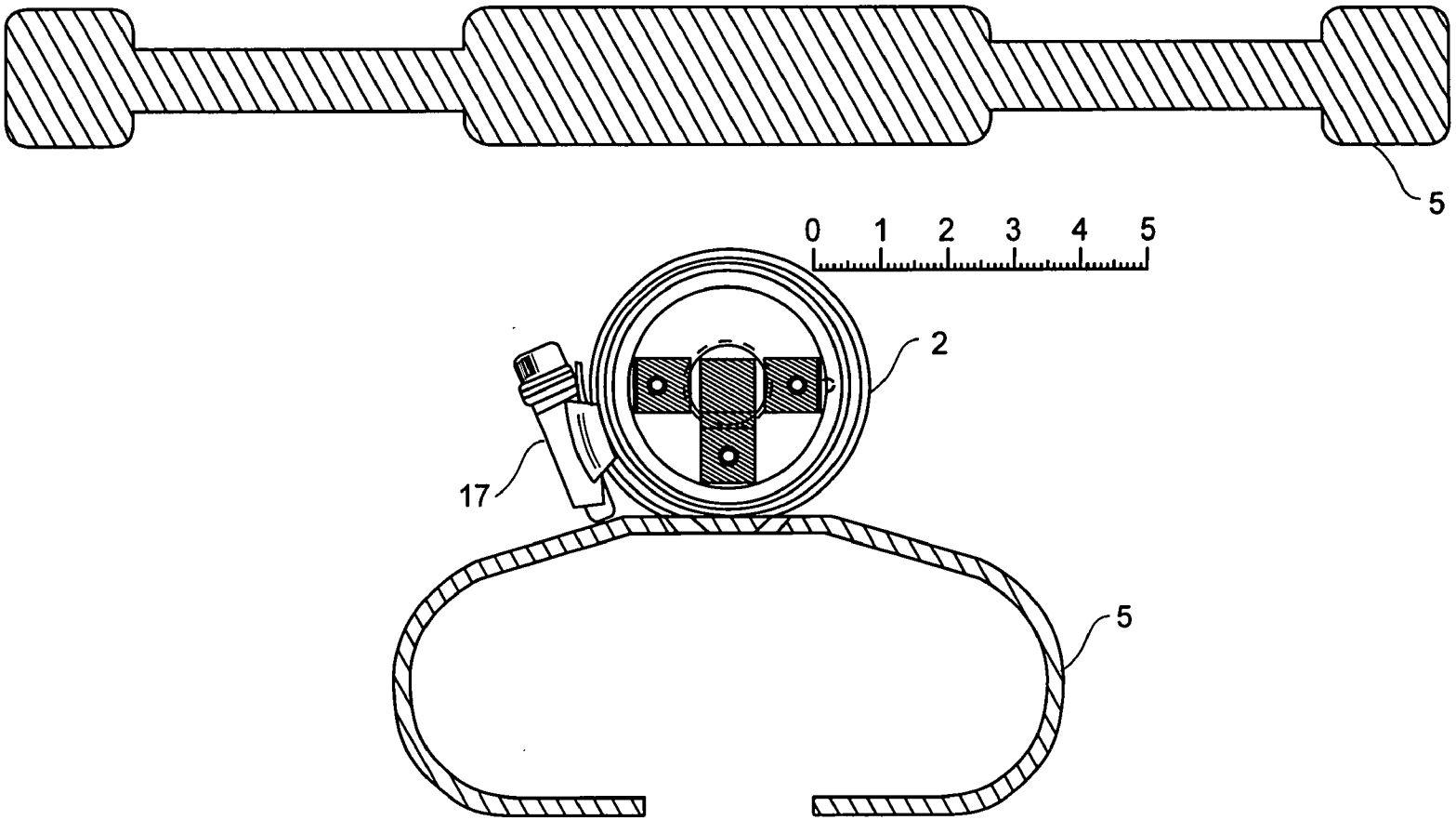
FIG. 2*b* is a simplified diagram illustrating a hand mount assembly of the converter shown in FIGS. 1 and 2*a;*

Referring to FIG. 1, a dive light converter 1 according to the present invention is shown, interposed between a battery compartment 8*b* and a head 8*a* of a commercially available dive light—indicated by dashed lines. In a preferred embodiment shown in FIGS. 2 to 6 the dive light converter 1 comprises a male adaptor 2, a female adaptor 3, a connecting cable 4, a hand-mount assembly 5, and a belt attachment assembly 6. The male adaptor 2 comprises a housing 7 for mating with the dive light head 8*a* in the form of, for example, a screw thread, and a seal 10 such as an o-ring interposed between the housing 7 and the dive light head 8*a*, as shown in FIG. 2. Mating of the housing 7 with the dive light head 8*a* provides a compression fitting of the o-ring 10 made of, for example, Neoprene® ensuring proper sealing of the connection for water depths of approximately 150 m. The female adaptor 3 comprises a housing 11 for mating with the dive light battery compartment 8*b*. Similarly to the male adaptor 2, the housing 11 is preferably made of a plastic material and proper sealing is ensured through compression fitting of an o-ring. As is evident to one of skill in the art it is possible to reverse the arrangement of the male and the female adaptors, depending on the design of the dive light to be converted. Furthermore, depending on the design of the dive light to be converted it is possible to employ other sealing means as well as other means for mating the adapters therewith. Optionally, a loop strap or a clip 21 is affixed to the housing 7 for attaching the housing 7 to, for example, a shoulder D-ring of a harness worn by the diver.

The hand mount assembly 5 comprises, for example, an ergonomically bent and perforated, malleable aluminum or stainless steel strip 16 affixed to the housing 7 via a hose clamp 17 or a bracket 18 allowing the head of the dive light 8*a* to be worn on the back of either hand, and be adjusted to fit by hand pressure. Optionally, the hand mount assembly is made of a plastic material and affixed to housing 7 or, further optionally, the housing 7 and hand mount assembly 5 are made of a same plastic material as a single piece.

Alternatively, the housing 7 is affixed to or comprises a head mount assembly comprising, for example, an adjustable ring made of a metal strip or plastic material for fitting the circumference of a diver's head. Further alternatively, the housing 7 is affixed to or comprises a mounting device for mounting to a breathing mask of a diver's breathing apparatus.

Figure 3:
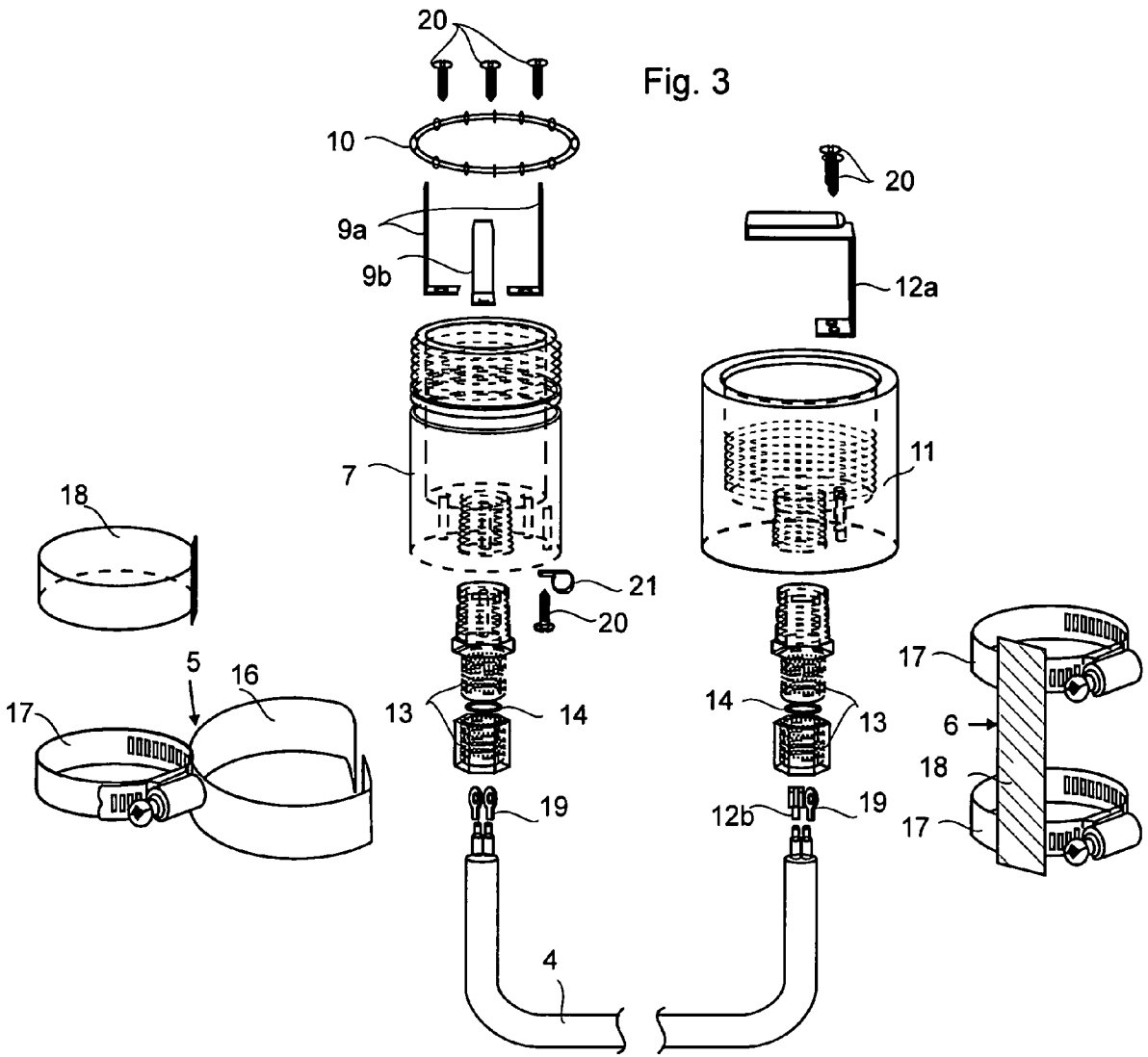
FIG. 3 is simplified block diagram schematically illustrating an exploded view of the converter according to the invention; and, FIGS. 4 to 8 are simplified block diagrams schematically illustrating details of a male and a female adaptor of the converter according to the invention.

The belt attachment assembly 6 shown in FIGS. 1, 2, and 3 comprises two hose clamps 17 and a strap 18 made of, for example, nylon webbing. The strap 18 is folded back and attached to itself using, for example, Velcro®, forming a loop around a belt to be worn around a diver's waist. The strap 18 is attached to the battery compartment 8*b* via the two hose clamps 17. Alternatively, the belt attachment 6 is affixed to the female adapter 3. Further alternatively, the strap 18 is dimensioned for attaching the battery compartment 8*b* and the female adapter 3 to a diver's upper or lower arm. Yet further alternatively, the strap is dimensioned for attaching the battery compartment 8*b* and the female adapter 3 to a tank of a diver's breathing apparatus. Optionally, the strap 18 is replaced by a magnet affixed to either the battery compartment 8*b* or the female adapter 3 for attachment to the tank. Of course, one of skill in the art will easily find various different designs for attaching the battery compartment 8*b* or the female adaptor 3 to various parts of a diver's gear.

The connecting cable 4 is of sufficient length to reach from a diver's waist to a hand with extended arm. Preferably, the connecting cable 4 is resistant to compression and wicking, 8–10 mm in diameter to resist kinking, and having a high strand count allowing repeated flexing.

Figure 4:
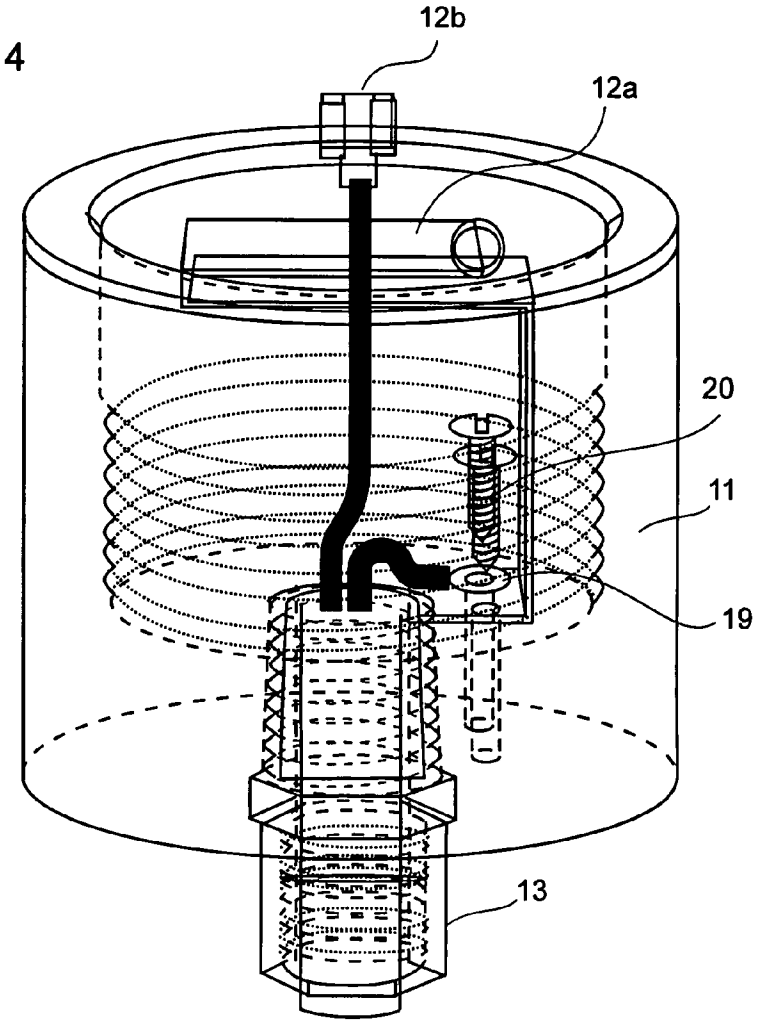
Figure 4:
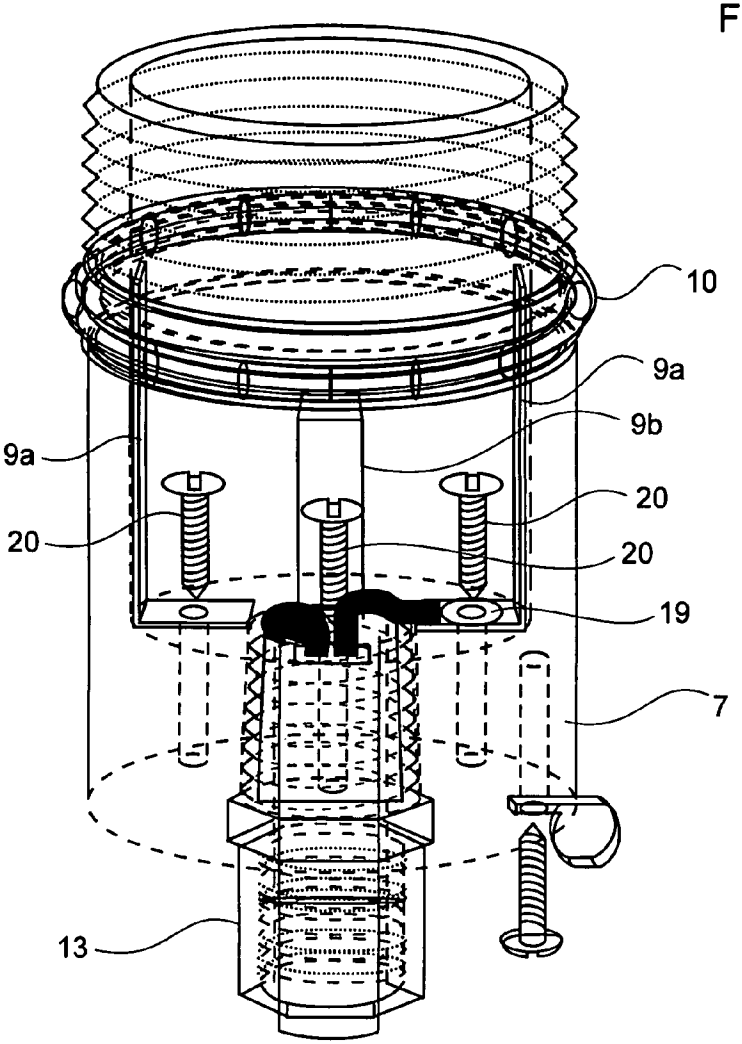
Figure 5:
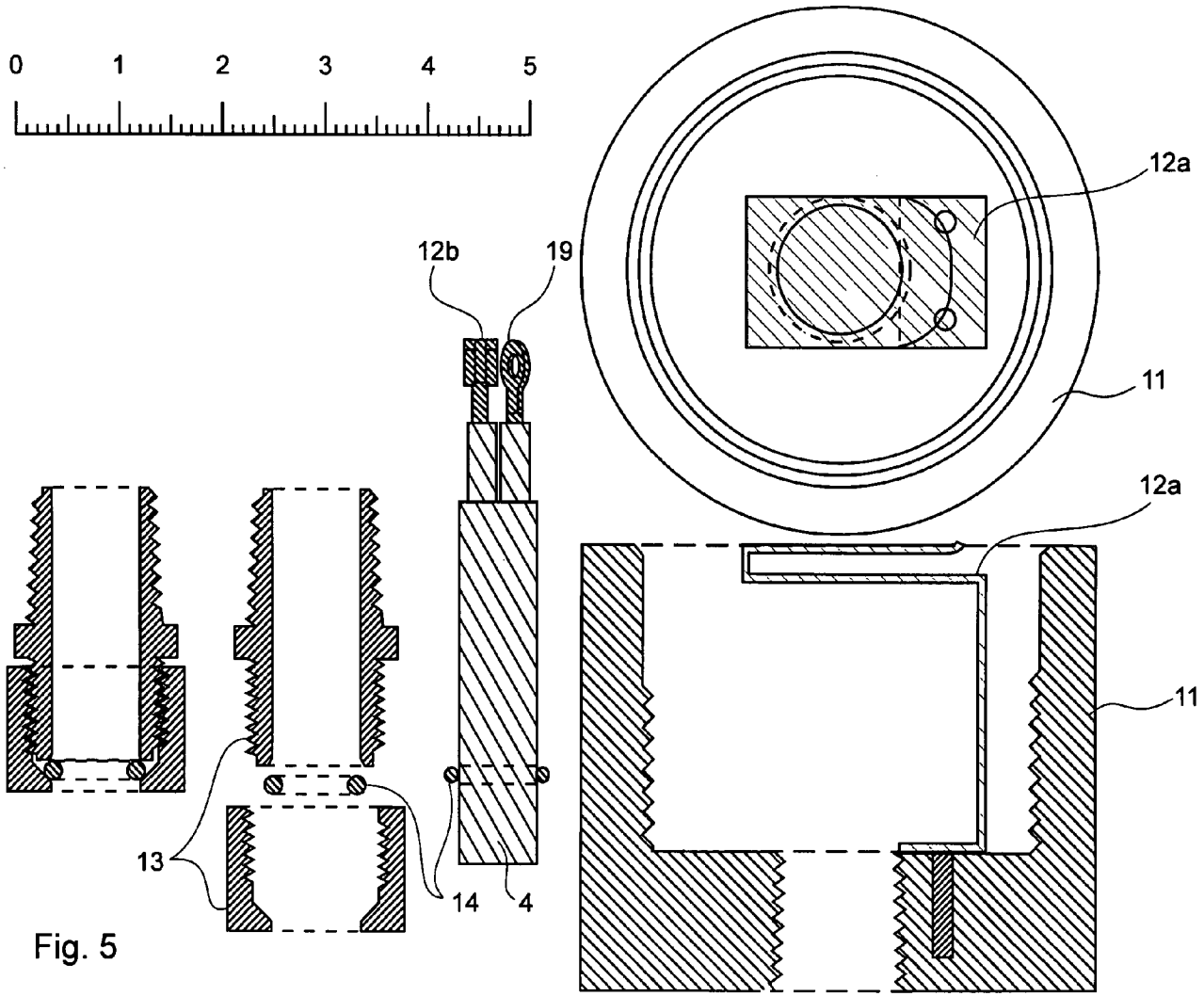
Figure 5A:
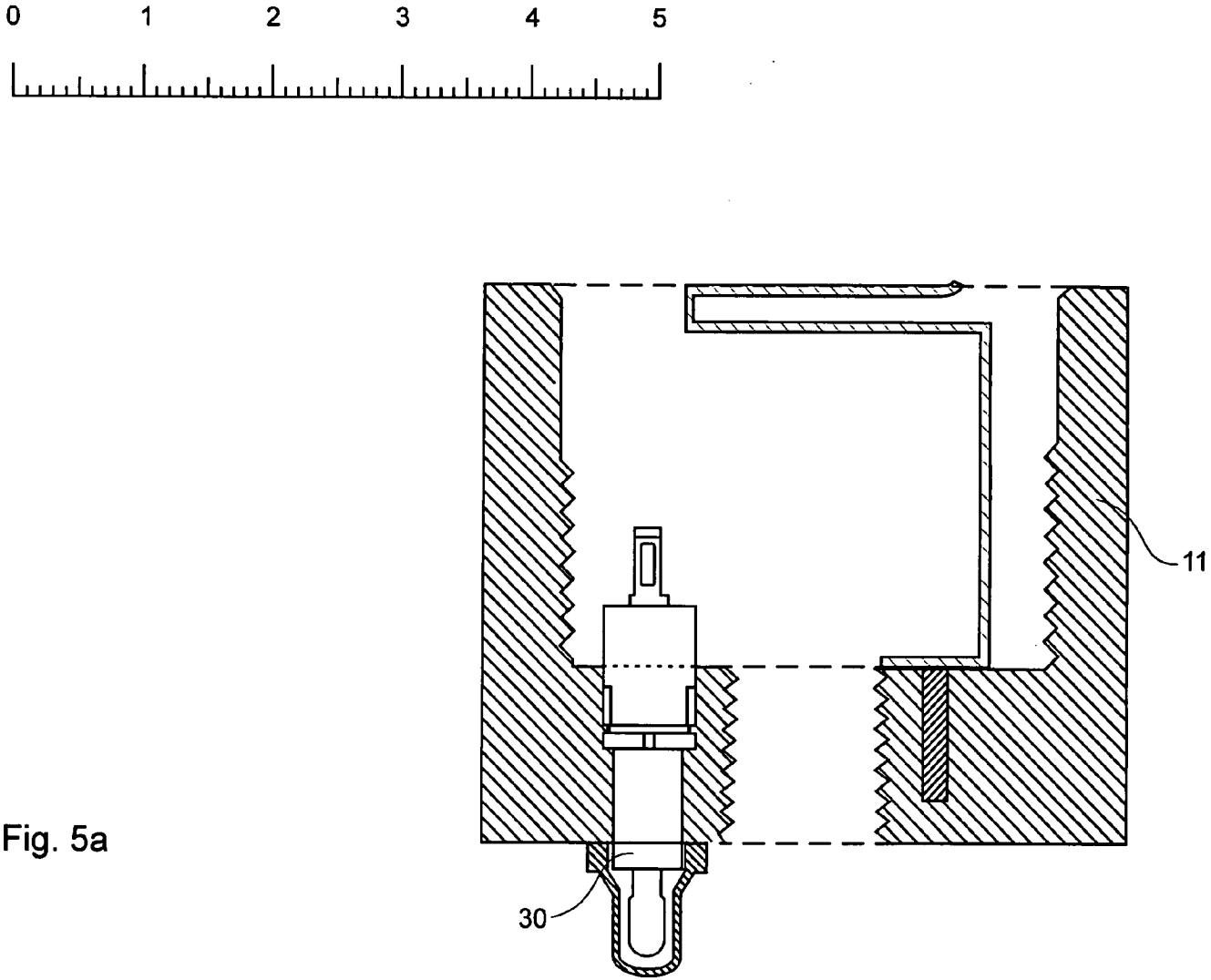
Figure 6:
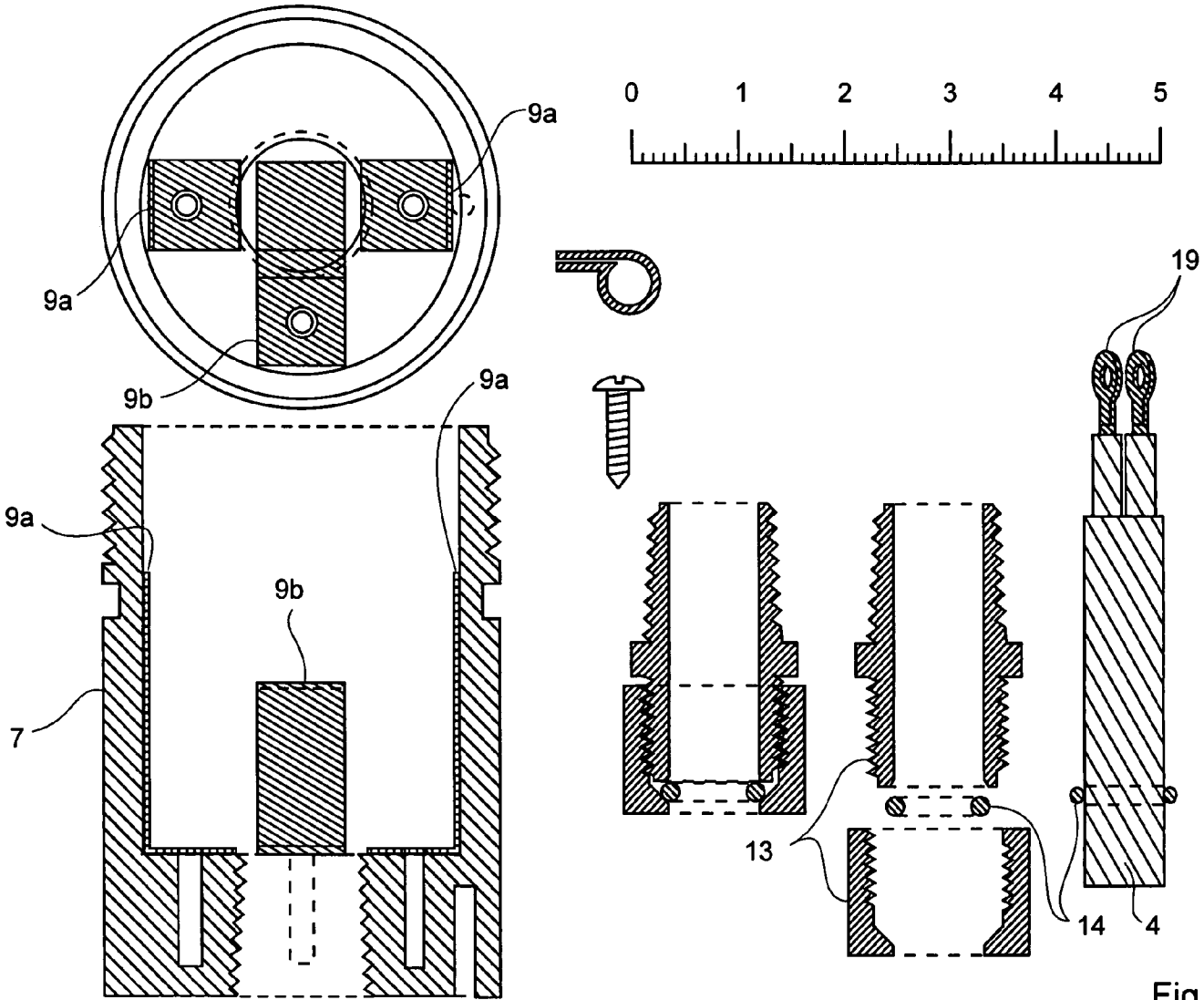

As shown in FIGS. 3 and 4, the male housing 7 comprises electrical contacts 9*a* and 9*b* for engaging respective electrical contacts of the dive light head 8*a* when the housing 7 is mated therewith. Optionally, the electrical contacts 9*a* and 9*b* are designed to come into contact after the housing 7 is mated with the dive light head 8*a* and sealed by compression seal 10, providing ON/OFF switching of the light by slightly turning the housing 7 with respect to the dive light head 8*a* while preserving the sealing functionality of the compression seal 10. Optionally, a switch 30 is provided in one of the male 7 or female 11 housing, as shown in FIG. 5*a*. For example, a commercially waterproof booted toggle switch is provided in the female housing 11, obviating turning of the housing 7 with respect to the dive light head 8*a*, thus substantially reducing the risk of flooding. The female housing 11 comprises electrical contacts 12*a* and 12*b* for engaging respective electrical contacts of the battery compartment 8*b*. Preferably, the contact 12*a* is designed to come into contact with a battery and a battery tray within the battery compartment 8*b*, and to keep the battery tray in alignment with the female adaptor 3 thus avoiding wire twist when engaging the female adaptor 3 with the battery compartment 8*b*. The contact 12*b* is a commercially available quick disconnect for engaging a respective contact of the battery compartment prior engagement of adaptor 3 with the compartment 8*b*. Preferably, the wiring is attached to the electrical contacts 9*a*, 9*b*, 12*a*, 12*b* via ring terminals 19 and screws 20. The screws 20 also secure the electrical contacts 9*a*, 9*b*, 12*a*, 12*b* to the housings 7 and 11. Further preferably, the electrical contacts 9*a*, 9*b*, 12*a*, 12*b*, the ring terminals 19, and the screws 20 are made of, for example, stainless steel in order to prevent corrosion in a saltwater environment. Of course the above embodiment is only one example and one of skill in the art will easily find various different designs of electrical contacts for engaging electrical contacts of various commercially available dive lights.

Compression fittings 13, shown in FIGS. 3 to 6, are identical for the male 2 and the female 3 adaptors. In order to provide proper sealing a seal 14, for example, a Neoprene® o-ring is used around the connecting cable 4. The compression fittings 13 are affixed to the housings 7 and 11, respectively, in a sealing fashion using, for example, tapered screw threads. The compression fittings 13 act as a thru hull attachment for the connecting cable 4 to the adaptors 2 and 3, and further provide strain relief to the cable 4. Preferably, the compression fittings are made of, for example, stainless steel or brass. The compression fittings 13 are preferred as thru hull attachment for the connecting cable 4 in the converter according to the invention since they are widely employed in underwater devices and, therefore, readily available off the shelf. Furthermore, they are easily employed and provide proper sealing to water depths of approximately 150 m.

Figure 7:
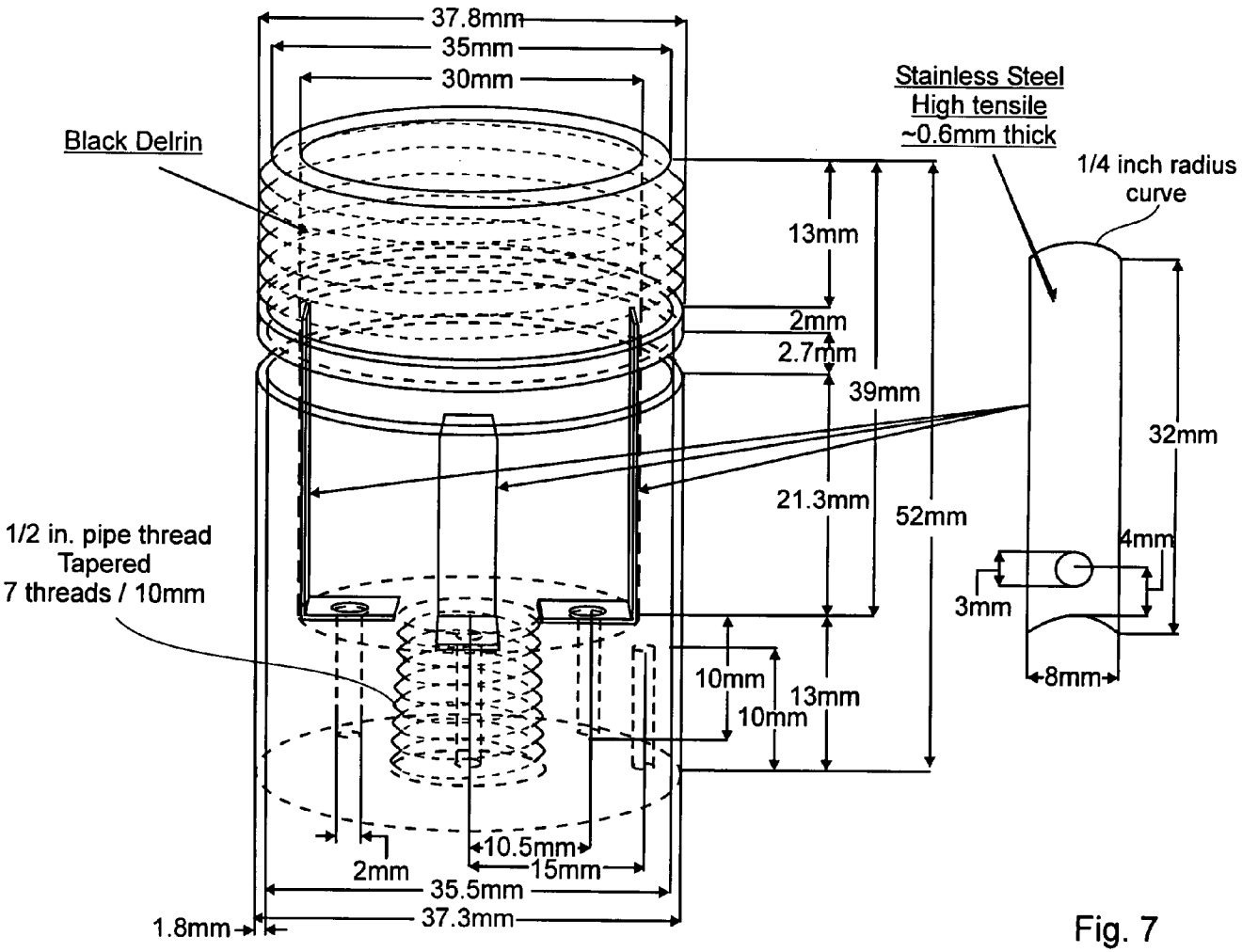
Figure 8:
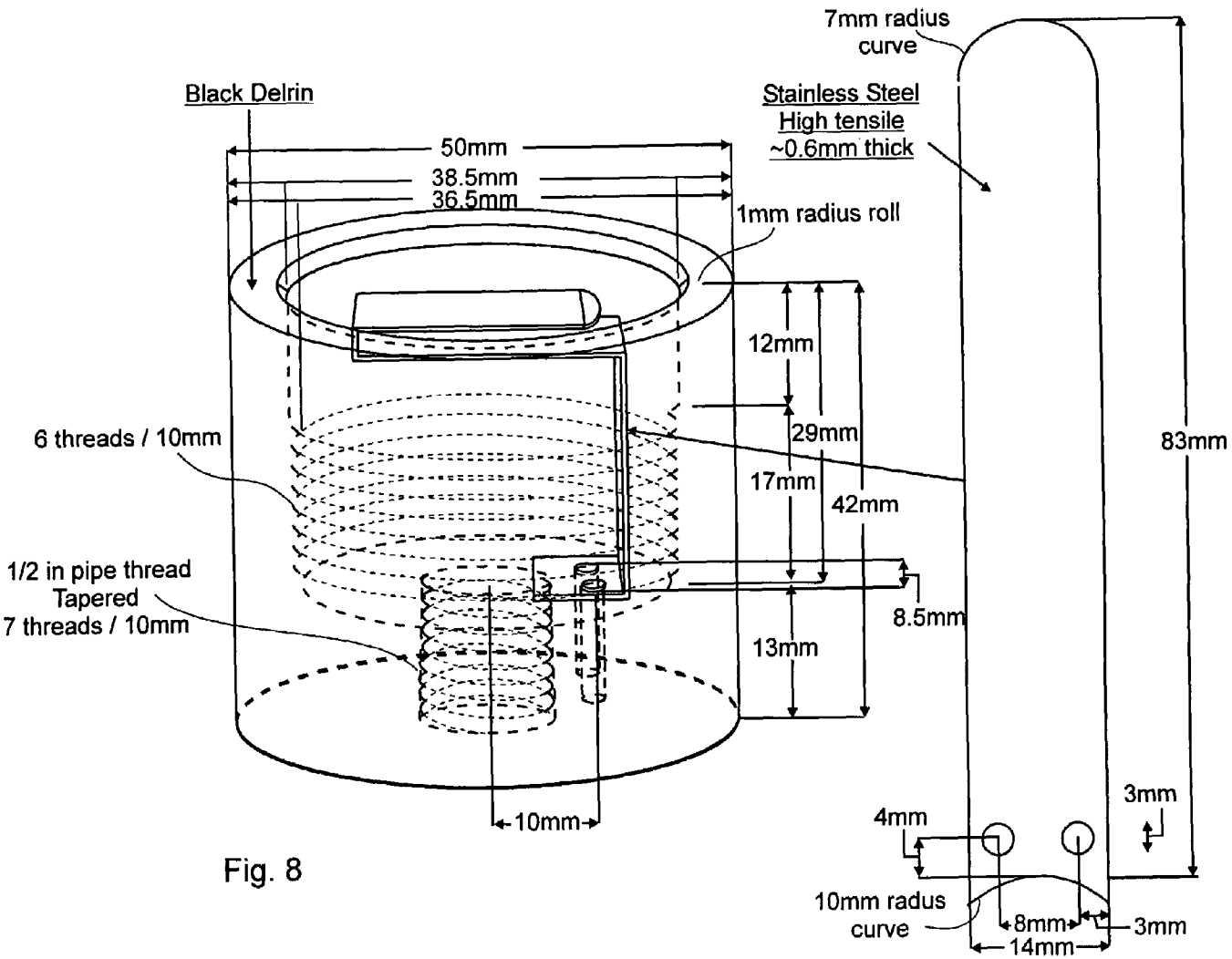

FIGS. 7 and 8 illustrate dimensions of the male adapter 2 and female adaptor 3, respectively, of a converter according to the invention.

Using the converter according to the invention a dive light is easily and quickly converted into a canister light by separating the dive light head 8*a* from the battery compartment 8*b*, mating the male adaptor 2 with the dive light head 8*a*, connecting electrical contact 12*b* of the female adaptor 3 with the respective electrical contact of the battery compartment 8*b*, and mating the female adaptor 3 with the battery compartment 8*b*. After these simple steps the converted dive light is ready for use as a canister light without requiring any technical skills from a user for conversion.

The converter according to the present invention is highly advantageous by enabling recreational divers and beginners to convert a dive light into a canister light. The conversion process is very simple and quick enabling a user to quickly convert a dive light without requiring technical skills. A converted dive light frees both hands of a diver by still providing sufficient illumination, particularly for situations encountered by recreational divers and beginners. The converter according to the present invention is manufactured at relatively low cost enabling recreational divers and beginners to acquire a converted dive light at relatively low cost compared with commercially available canister lights. Freeing both of a diver's hands and obviating the need for switching hands when holding a dive light substantially increases safety. Furthermore, the battery compartment of a dive light is substantially smaller and lighter than a battery canister of a typical canister light. Therefore, using the converter according to the present invention provides a converted dive light having a substantially less bulky and less heavy battery canister thus increasing safety for less experienced divers such as recreational divers and beginners. Finally, should a diver having a converted dive light choose to acquire a canister light he or she can use the dive light as a back-up.

Numerous other embodiments of the invention will be apparent to persons skilled in the art without departing from the spirit and scope of the invention as defined in the appended claims.

What is claimed is:

1. A converter comprising:

a first adaptor for mating in a waterproof fashion with a head of a dive light, the first adaptor comprising first electrical contacts for engaging electrical contacts of the head of the dive light;

a second adaptor for mating in a waterproof fashion with a battery compartment of the dive light, the second adaptor comprising second electrical contacts for engaging electrical contacts of the battery compartment of the dive light;

a connector cable having a first end affixed to the first adaptor in a waterproof fashion and a second end affixed to the second adaptor in a waterproof fashion, the connector cable for providing electrical communication between the first and the second electrical contacts; and, a first mount assembly affixed to the first adaptor, the first mount assembly for attaching the first adaptor to one of a back of a hand, a head, and a mask of a breathing apparatus.

2. A converter as defined in claim 1 wherein the first and the second adaptor comprise a screw thread designed for engaging respective screw threads of the head and the battery compartment of the dive light.

3. A converter as defined in claim 1 comprising a second mount assembly for being affixed to the battery compartment, the second mount assembly for attaching the battery compartment to one of a belt, an upper arm, a lower arm, and a tank of a breathing apparatus.

4. A converter as defined in claim 1 comprising a second mount assembly affixed to the second adaptor, the second mount assembly for attaching the battery compartment to one of a belt, an upper arm, a lower arm, and a tank of a breathing apparatus.

5. A converter comprising:

a first housing for mating in a waterproof fashion with a bead of a dive light at a first end, the first housing comprising an opening at a second opposite end;

first electrical contacts disposed within the first housing, the first electrical contacts for engaging electrical contacts of the head of the dive light;

a second housing for mating in a waterproof fashion with a battery compartment of the dive light at a first end, the second housing comprising an opening at a second opposite end;

second electrical contacts disposed within the second housing, the second electrical contacts for engaging electrical contacts of the battery compartment of the dive light;

a connector cable having a first end affixed to the first housing in a waterproof fashion and a second end affixed to the second housing in a waterproof fashion, the connector cable for providing electrical communication between the first and the second electrical contacts;

first and second compression fittings for affixing the first and the second end of the connecting cable to the opening of the first and the second housing, respectively, in a waterproof fashion;

a first mount assembly affixed to the first housing, the first mount assembly for attaching the first housing to one of a back of a hand, a head, and a mask of a breathing apparatus; and, a second mount assembly for attaching the one of the battery compartment and the second housing to one of a belt, an upper arm, a lower arm, and a tank of a breathing apparatus.

6. A converter as defined in claim 5 wherein the second mount assembly comprises a mechanism for affixing tile same to the battery compartment.

7. A converter as defined in claim 5 wherein the second mount assembly is affixed to the second housing.

8. A converter as defined in claim 5 wherein the first end of the first and the second housing comprises a screw thread designed for engaging respective screw threads of the head and the battery compartment of the dive light.

9. A converter as defined in claim 5 wherein the first and the second housing are made of a plastic material.

10. A converter as defined in claim 5 wherein the first mount assembly is integrated into the first housing.

11. A converter as defined in claim 5 wherein the first mount assembly comprises a bent metal strip affixed to the first housing.

12. A converter as defined in claim 5 wherein the second mount assembly comprises a strap forming a loop.

13. A converter as defined in claim 5 comprising an o-ring for providing a compression seal between the first housing and the head of the dive light.

14. A converter as defined in claim 5 wherein the first electrical contacts are designed to come into contact after the first housing is mated with the head of the dive light for providing ON/OFF switching of the dive light by slightly turning the first housing with respect to the head of the dive light while keeping the first housing and the head of the dive light mated in a waterproof fashion.

15. A converter as defined in claim 5 comprising a switch disposed in one of the firsts and the second housing for providing ON/OFF switching of the dive light.

16. A method for converting a dive light comprising:

providing a first adaptor, the first adaptor comprising first electrical contacts for engaging electrical contacts of a head of the dive light when the first adaptor is mated with the head of the dive light, a second adaptor, the second adaptor comprising second electrical contacts for engaging electrical contacts of a battery compartment of the dive light when the second adaptor is mated with the battery compartment of the dive light, and a connector cable having a first end affixed to the first adaptor in a waterproof fashion and a second end affixed to the second adaptor in a waterproof fashion, the connector cable for providing electrical communication between the first and the second electrical contacts;

providing a first mount assembly affixed to the first adaptor, the first mount assembly for attaching the first adaptor to one of a back of a hand, a head and a mask of a breathing apparatus;

mating in a waterproof fashion the first adaptor with the head of the dive light; and, mating in a waterproof fashion the second adaptor with the battery compartment of the dive light.

* * * * *